United States Patent [19]

Oefinger et al.

[11] Patent Number: 4,517,820

[45] Date of Patent: May 21, 1985

[54] BLIND RIVET TOOL

[75] Inventors: Richard W. Oefinger, Shelton; Richard J. Babyak, Trumbull, both of Conn.

[73] Assignee: USM Corporation, Farmington, Conn.

[21] Appl. No.: 506,659

[22] Filed: Jun. 22, 1983

[51] Int. Cl.[3] ..... B21J 15/34

[52] U.S. Cl. ..... 72/391; 72/453.17; 29/243.53; 91/469

[58] Field of Search ..... 72/391, 453.17, 453.19; 29/243.53; 91/469; 251/231, 236

[56] References Cited

U.S. PATENT DOCUMENTS

| | | | |
|---|---|---|---|
| 3,254,522 | 6/1966 | Elliott et al. | 72/391 |
| 4,045,994 | 9/1977 | DiMaio et al. | 72/391 |
| 4,120,188 | 10/1978 | Schwab | 72/391 |

FOREIGN PATENT DOCUMENTS

| | | | |
|---|---|---|---|
| 2154788 | 5/1973 | Fed. Rep. of Germany | 72/391 |
| 1286466 | 8/1972 | United Kingdom | 72/391 |

*Primary Examiner*—Daniel C. Crane
*Assistant Examiner*—David B. Jones
*Attorney, Agent, or Firm*—Alan N. McCartney

[57] ABSTRACT

A light weight heavy duty blind rivet setting tool having one piece upper housing containing a rivet setting mechanism and a one piece lower pressure vessel having an air activated piston operable to pressurize a medium in the upper housing to activate the rivet setting mechanism. The upper housing has a handle area containing a trigger which, through a trigger linkage, operates a valve on the bottom of the pressure vessel which is connectable to an air source. A muffler is positioned adjacent the valve to receive the exhausted air from the pressure vessel after the tool has been operated, to minimize the noise level of the tool operation. The trigger linkage is adjustable to eliminate the tolerance stack-up in the linkage.

5 Claims, 9 Drawing Figures

BLIND RIVET TOOL

BACKGROUND OF THE INVENTION

1. Field of the Invention

This invention relates to heavy duty power operated blind rivet tools that set a blind rivet having a mandrel that pulls through a rivet body to upset the rivet body in a workpiece.

2. Prior Art

There are many tools on the market for setting blind rivets of the type having a mandrel that pulls through a rivet to upset the rivet body. These tools fall generally into the classification of hand operated or power operated tools. An example of a hand operated tool is illustrated in U.S. Pat. No. 3,324,700. The power operated tools are for heavy duty continuous assembly line type operation, and examples of such tools are illustrated in U.S. Pat. Nos. 3,088,618 and 3,254,522.

Some of the power operated tools also have a provision for collecting the spent mandrels in a canister at the rear of the tool. An example of tools with mandrel collection systems of this type are shown in U.S. Pat. Nos. 3,415,102 and 4,281,531.

None of the above mentioned tools however, have the unique features of the power tool disclosed herein, wherein the tool is of light weight construction with a minimum of operating parts. Tools of this type are used in an assembly line environment wherein the tool is continuously operated over an extended period of time. These tools should be lightweight to minimize operator fatigue and have a minimum of operating parts for durability and long life.

BRIEF SUMMARY OF THE INVENTION

The novel tool of this invention is a light weight heavy duty power operated blind rivet tool that has a minimum number of operating parts.

It is an object of this invention to provide a blind rivet power tool having a one piece upper housing containing a rivet setting mechanism and a one piece lower housing having a pressure vessel. The upper housing is adapted to be held by the operator. The pressure vessel has a piston operated in response to air pressure controlled by a valve located at the bottom of the pressure vessel that communicates with an air source. This places the air line to the tool remote from the hand held portion of the tool so that the operator is not inhibited by the air line when operating the tool. Further, the valve is recessed within a flange on the lower housing so the tool can stand upright when not in use.

A further object of this invention is the provision of an adjustable trigger linkage which is connected between a trigger on the upper housing and a valve at the bottom of the pressure vessel which controls the air supply to the pressure vessel.

It is a further object of this invention to provide a one piece construction for the upper and lower tool housings with an interconnection between the housings of a type that enables the pressure vessel to be constructed of a light weight synthetic material resulting in the overall tool being light weight to minimize operator fatigue.

It is another object of this invention to connect the exhaust side of the control valve to a damping member so that air exhausted from the tool during operation will be muffled to minimize the noise level from the tool operation.

It is a further object of this invention to provide in a blind rivet setting tool a spent mandrel collection system at the rear of the rivet setting mechanism. The collection system has a transducer in an adapter mounted on the rear of the tool. The transducer is connected to an air line located internally of the tool and in communication with the air source. The air passes through the transducer creating a vacuum in the adapter and a container mounted on the adapter to pull the spent mandrel through the tool into the container.

It is still another object to provide in a power operated blind rivet tool a one piece upper housing containing a rivet setting mechanism, the upper housing being attached to a one piece lower housing containing an air pressure actuated power means which operates the rivet setting mechanism. The lower housing has a control valve which is recessed within a flange at the bottom of the housing so that the tool can stand upright. The upper housing has a trigger that actuates upper and lower trigger rods, the lower trigger rod having a threaded lower trigger rod shoe that rides against an inclined face of a plunger that is connected to the control valve.

DESCRIPTION OF THE PREFERRED EMBODIMENT

Figure 1:
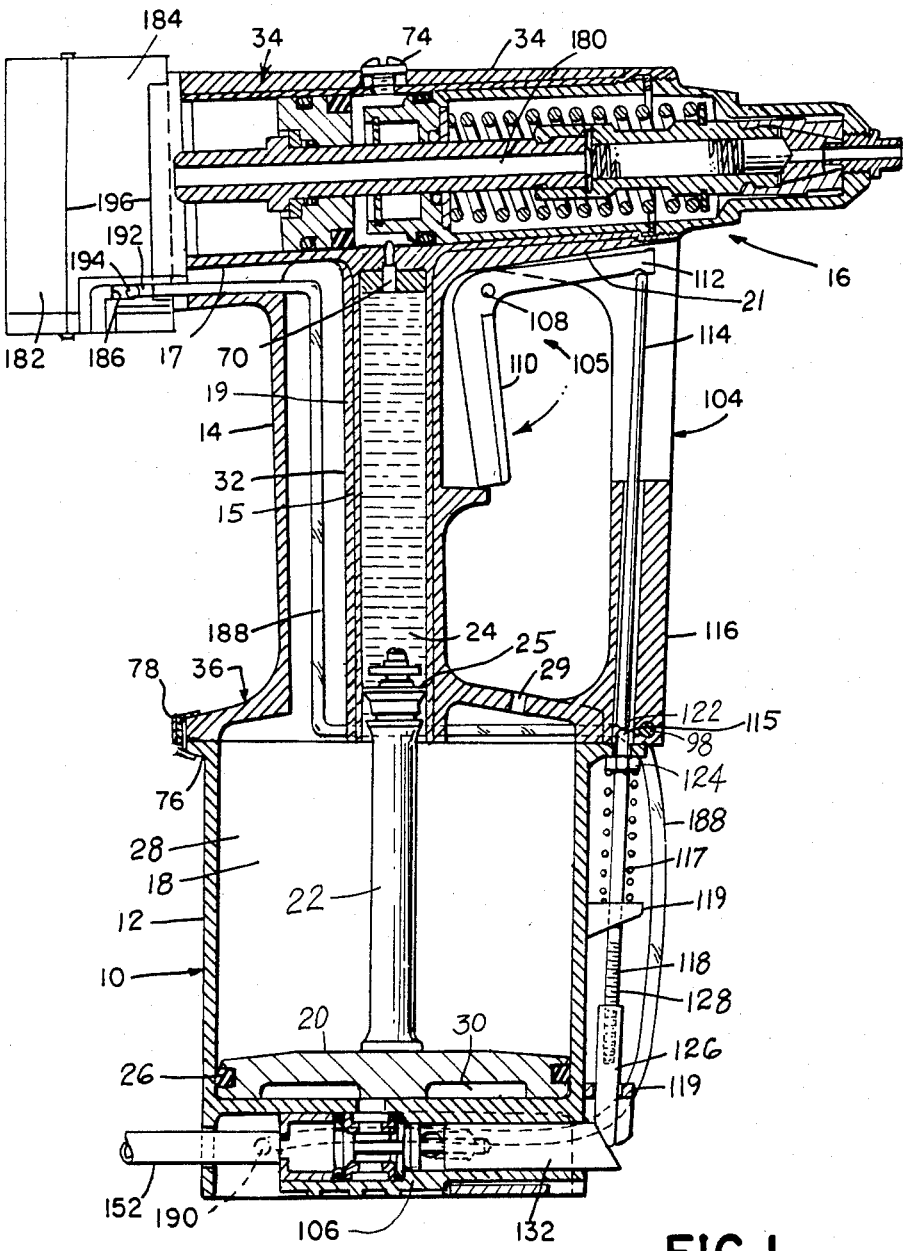
FIG. 1 is a cross-sectional view of the blind rivet setting tool of this invention.

Attention is now directed to FIG. 1 which illustrates the blind rivet setting tool of this invention as having a one piece lower housing 10 containing the pressure vessel 12 and a one piece upper housing 14 containing the rivet setting mechanism 16. The upper housing 14 has a metal sleeve 15 in the tool handle area 32 and a metal sleeve 17 in the rivet setting mechanism 16. The sleeves 15 and 17 are surrounded by a glass filled nylon 19, 21 which lends sufficient rigidity to the upper housing while enable the tool to be a light weight construction.

The pressure vessel 12 is cylindrical and has an opening 18 receiving a piston 20. The piston 20 has a piston rod 22 carried in the central open cylindrical area 24 of the upper housing 14. The piston 20 has an annular sealing ring 26 sealing the upper area 28 of the vessel from the lower area 30 of the vessel. The open area 24 in the tool handle 32 contains hydraulic fluid. The end 25 of the rod 22 has a seal 27. The lower area 30 of the vessel is adapted to be subjected to compressed air to move the piston 20 upwardly and compress the hydraulic fluid to operate the rivet setting mechanism 16 as will become apparent hereinafter. At the same time, the air located in the upper area 28 is exhausted through ports 29.

Figure 3:
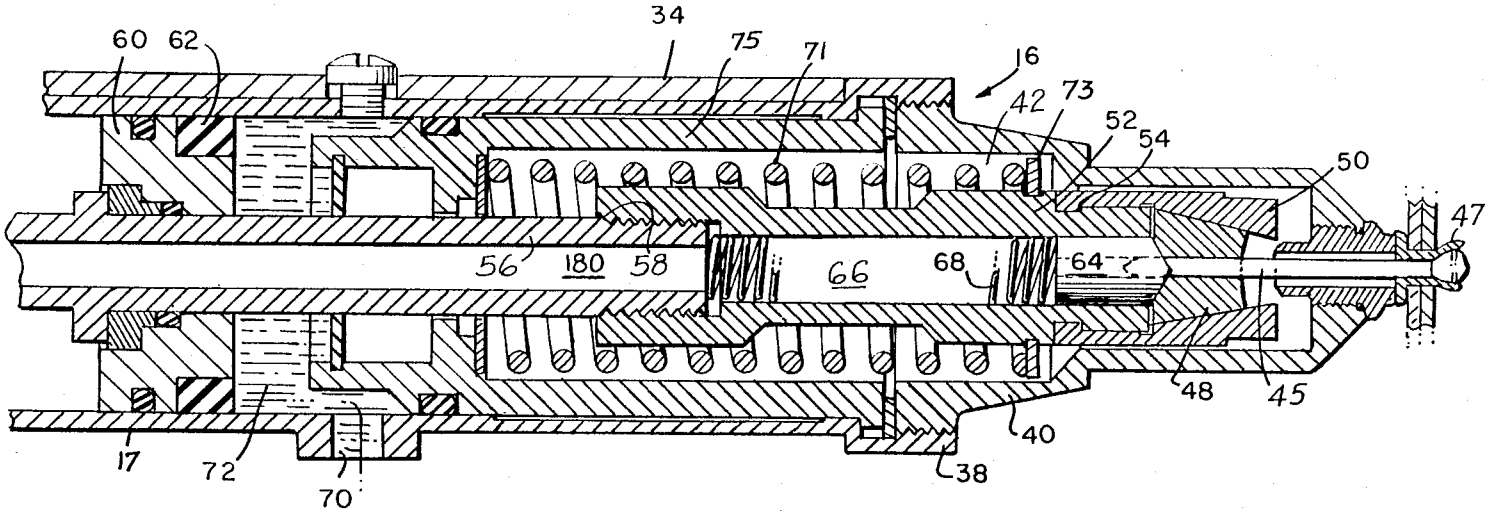
FIG. 3 is a view similar to FIG. 2 illustrating the rivet setting mechanism in the operative position of pulling a rivet mandrel to upset the rivet body in a workpiece.
Figure 4:
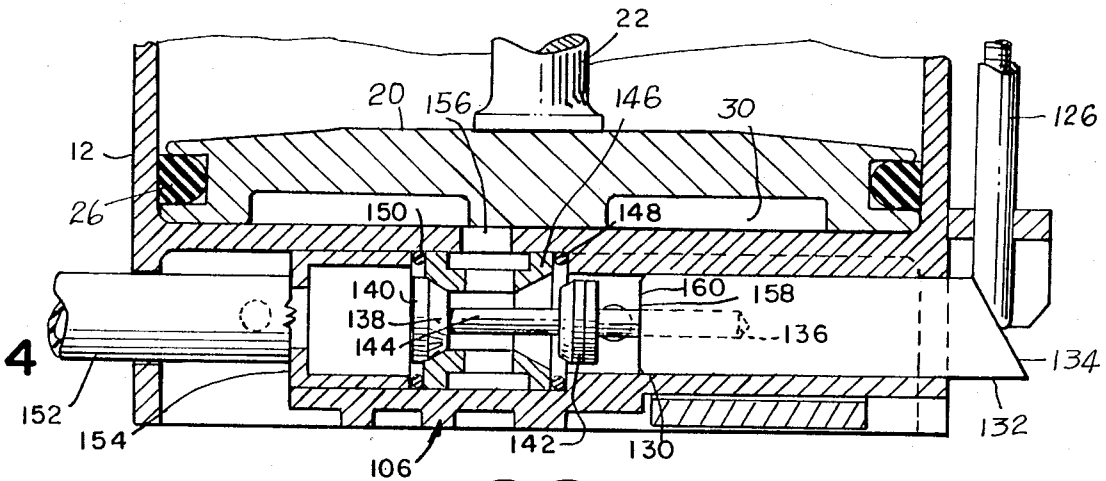
FIG. 4 illustrates the control valve located at the bottom of the pressure vessel in a closed position exhausting the vessel.

Reference is now made to FIGS. 3 and 4 which illustrate the details of the rivet setting mechanism 16 carried within the cylindrical upper housing sleeve 17. Threaded into sleeve 17 at 38 is a sleeve 40 enclosing a mandrel pulling mechanism 42. Threaded into the opening 44 in sleeve 40 is a nosepiece 46 which receives the mandrel 45 of the rivet 47, as is well known in the art.

The mandrel pulling mechanism 42 comprises a pair of jaws 48 which are adapted to grip the rivet mandrel 45. Surrounding the jaws 48 is a jaw guide 50 attached to a draw bar 52 through interlocking shoulders 54. The draw bar 52 is threaded to a piston rod 56 through interlocking sloped shoulders 58. A piston 60 in the sleeve housing 17 is attached to a piston rod 56. A seal 62 is located adjacent the piston 60 in the sleeve housing 38. A jaw pusher 64 is carried in an opening 66 in the draw bar 52 and is biased by a spring 68 aganst the jaws 48 to keep the jaws 48 separated into an open condition. The jaws are also forced against the nosepiece 46 to be forced open.

In the operation of the rivet setting mechanism, as the hydraulic fluid in the pressure vessel 12 is condensed by upward movement of piston 20, the fluid passes through an opening 70 into an area 72 behind the piston 60 causing it to move to the left as shown in FIG. 3. The initial movement of the piston 60 moves the draw bar 52 and the jaw guide 50 to force the jaws 48 against the rivet mandrel. Further movement of the piston 60 will draw the mandrel through the rivet to upset the rivet, as is well known in this art. A spring 71 is carried between O-ring 73 on the draw bar 52 and rear of cylinder 75 surrounding the piston rod 56. This spring returns the rivet setting mechanism after it has been operated.

Figure 2:
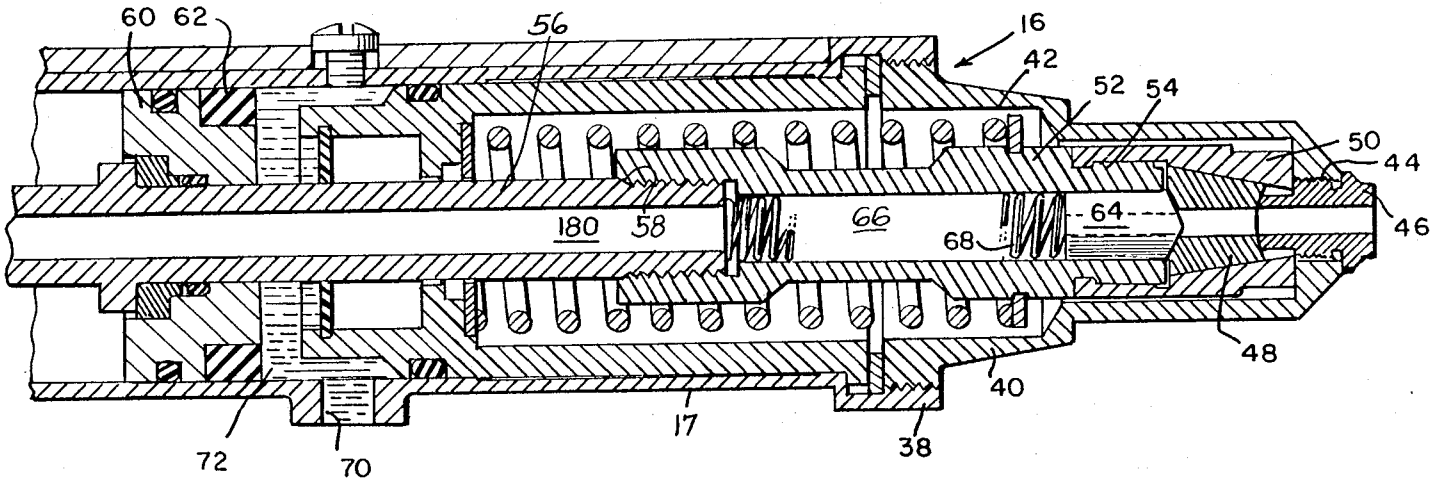
FIG. 2 is a sectional view of the rivet setting mechanism in a non-operative position.

Attention is now directed to FIGS. 2 and 3 which illustrate the sloped shoulder interconnection 58 between the draw bar 52 and the piston rod 56. It has been determined that bottoming the threads between the draw bar 52 and the piston rod 56 lends strength to the piston rod in this area prevents the rod from breaking over a long period of use. The angular or sloped shoulder interconnection 58 with the draw bar 52 lends considerable life to the piston member due to reduced fatigue cycling at this location. As the draw bar and piston rod are threaded together, the piston rod metal becomes loaded which in use means the piston rod metal does not go from a loaded to unloaded condition but from a partially loaded to loaded condition which lowers the fatique cycle adding life to the piston rod at the interconnection of these parts.

Figure 7:
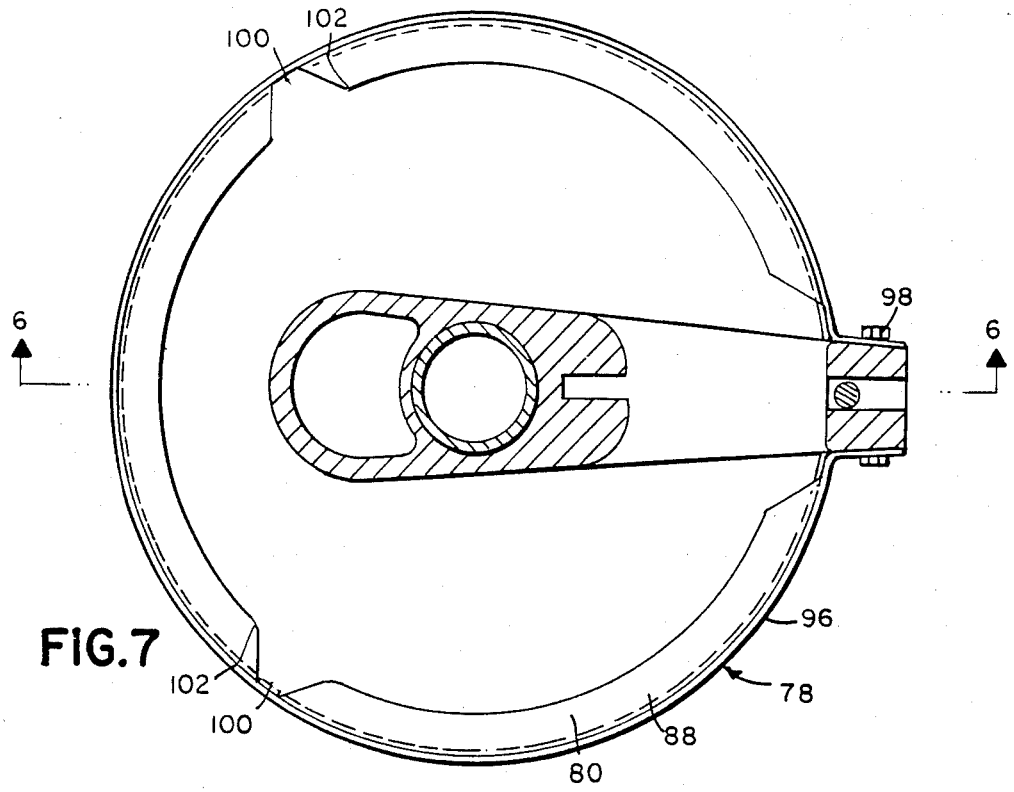
FIG. 7 is a top plan view of the connection between the upper and lower housings.
Figure 6:
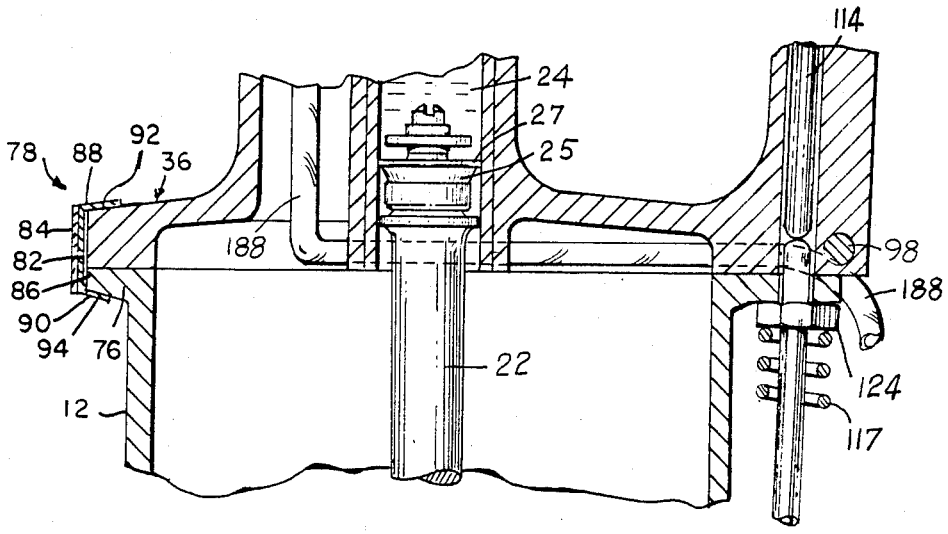
FIG. 6 is an enlarged sectional view taken along lines 6—6 of FIG. 7 illustrating the connection between the upper and lower housings of the tool.

The upper housing 14, as illustrated in FIG. 1, has the aforementioned integral handle portion 32 and sleeve 17 which receives the rivet setting mechanism 16 that is locked therein on the top side 34 by a set screw 74. The upper housing flange 36 is secured to the flange 76 of the pressure vessel by a clamping mechanism 78 (See FIGS. 6 and 7).

The clamping mechanism 78 comprises a plurality of U-shaped arcuate brackets 80 which surround the flanges of the housings. Each bracket 80 has a flat surface 82 abutting the edge portions 84, 86 of the flanges and upper and lower leg portions 88 and 90 which engage the upper and lower flange surfaces 92 and 94. A circular band 96 surrounds the flanges and engages the flat surfaces 82 of the brackets 80. The band 96 is secured at its ends by a bolt 98 which, when tightened, pulls the brackets onto the housing flanges 36, 76 to securely lock the housings together.

The above described interconnection between the upper and lower housing provides limited fatigue to both housing flanges caused by the pressurizing and de-pressurizing of the housings during the operation of the tool. Further, it should be noted the bracket legs 88, 90 are spaced at 100 from one another and have angled shoulder areas 102 which engage the housing flanges. It has been determined that the use of such angled shoulder areas (as opposed to a right angle contact area) reduces fatigue on the housing flanges in the area of contact with the bracket legs. Further, with this type of attachment between the housings, it has been determined that lower housing can be made of a synthetic material such as a glass filled nylon which reduces the overall weight of the tool.

Figure 5:
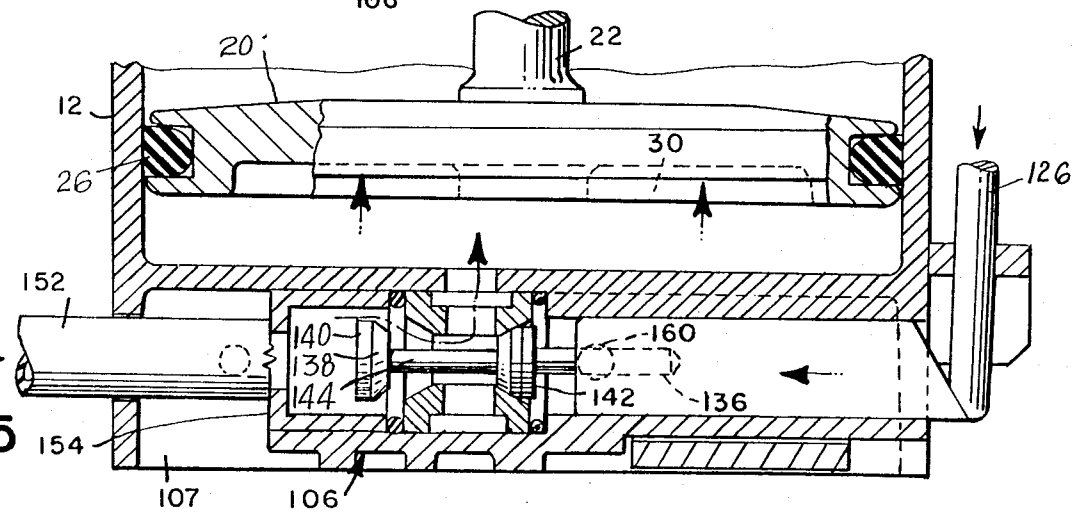
FIG. 5 illustrates the control valve in an open position to pass air from the air source into the pressure vessel during operation of the rivet setting mechanism.

Attention is now directed to FIGS. 1, 4 and 5 which illustrate a novel trigger mechanism 104 which activates a control valve 106 permitting pressurized air to enter the lower chamber 30 to operate the rivet setting mechanism 16 as previously described.

The trigger mechanism 104 comprises a trigger 105 pivoted at 108 to the upper housing handle area 32. The trigger 110 is adapted to be grasped by the fingers of the operator and the opposed leg 112 of the trigger engages an upper trigger rod 114. The upper trigger rod 114 passes through an upper trigger rod housing 116 secured to the upper housing. A lower trigger rod 118 is carried on brackets 119 attached to the front of the pressure vessel. The lower end 122 of the upper trigger rod 114 contacts the upper end 115 of the lower trigger rod 118. A hex head 124 is carried on the lower trigger rod 118. A spring 117 is positioned between bracket 119 and hex head 124. A shoe 126 is threaded into the lower end 128 of the lower trigger rod 118.

Attention is now directed to FIGS. 4 and 5 which illustrate the operation of the control valve 106.

The control valve 106 is carried in a cylindrical chamber 130 formed in the bottom of the lower housing 10. A plunger 132 slides in the cylindrical chamber 130 and has a sloping surface 134 contacted by the shoe 126 on the lower trigger rod 118. Secured within the plunger 132 is the rod 136 of a spool valve 138. The spool valve 138 has a pair of opposed valve members 140, 142 interconnected by a rod 144. The spool valve 138 is positioned within a valve seat 146 sealed with O-ring seals 148, 150 in the cylindrical chamber 130. An air line 152 from a source of compressed air (not shown) is secured to a nipple 154 within the opening 130.

In operation, air pressure in the air line 152 will force the valve member 140 to seat and the valve member 142 to be unseated as illustrated in FIG. 4. Once the trigger is pivoted by the operator, the trigger rods 114 and 118 move downwardly and the shoe 126 forces the plunger 132 to the left, as shown in FIG. 5, unseating valve member 140 and seating valve member 142. This movement of the plunger 132 also seals off the exhaust ports 160. This will permit air pressure to pass valve member 140 and into chamber 30 through opening 156 in valve seat 146 causing activation of the rivet setting mechanism in the manner previously described. (This action of the valve is illustrated in FIG. 5). After the rivet has been set and the trigger is released by the operator, the inlet pressure will again seat valve member 140 and unseat valve member 142. (This position is again illustrated in FIG. 4). The compressed hydraulic fluid will now force the air in chamber 30 out the opening 156 around valve member 142 and against the end 158 of plunger 132. This moves the plunger 132 to the right, which position is shown in FIG. 4, and moves the trigger rods 118 and 114 upwardly by the camming action of sloping cam surface 134 on nosepiece 126. Further, during the activation of the trigger, spring 117 becomes loaded and upon the release of the trigger, spring 117 will move the trigger rods upwardly. As the plunger 132 moves from the position illustrated in FIG. 5 to the position illustrated in FIG. 4 exhaust ports 160 located in the sides of the chamber 130 are opened.

It should also be noted that the entire control valve 106 is positioned up under the flange area 107 of the lower housing 10 which enables the entire tool to be set on a flat surface when not in use.

In the repeated operation of the trigger and valve mechanism, wear may occur in the various parts causing a loss of desired tolerance between the various operation parts (called tolerance stack-up). Since the shoe 126 is threaded into the lower trigger rod 118, turning the hex-head 124 on the lower trigger rod will adjust the length of the trigger rod to eliminate any slack in the trigger linkage. This will assure a consistent movement of plunger 132 for proper operation of the control valve 106.

Figure 8:
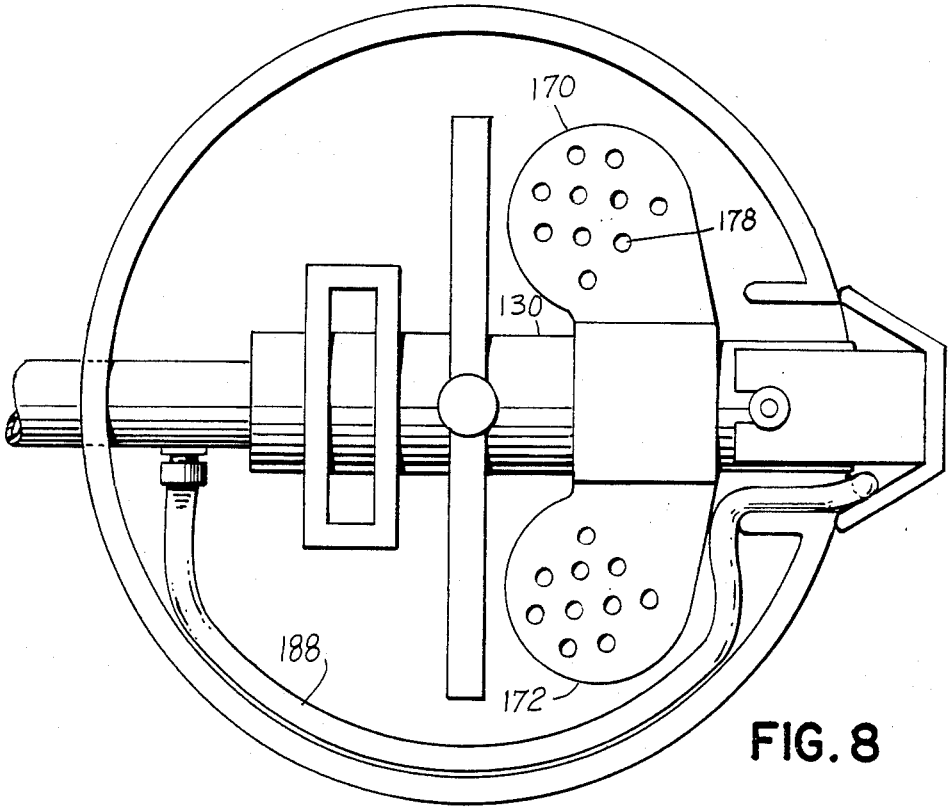
FIG. 8 is a bottom plan view of the tool illustrating the location of the muffler.
Figure 9:
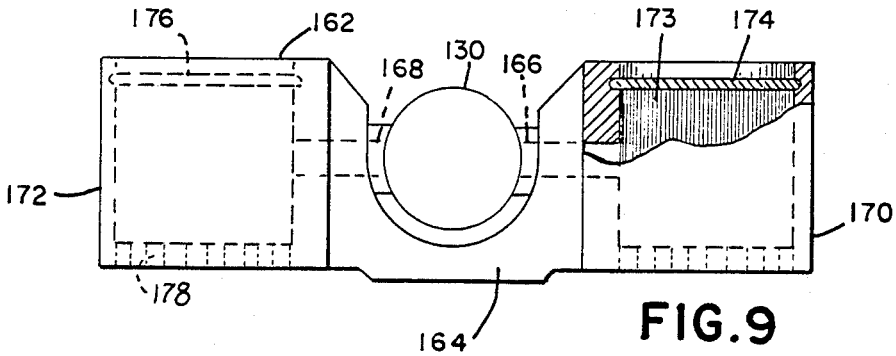
FIG. 9 is side elevational view of the muffler.

Reference is now made to FIGS. 8 and 9 which illustrate the muffler 162 that receives the outlet air from port 160 and condenses the air and slowly releases the air to lower the noise caused by the exhausting air. The muffler 162 comprises a central U-shaped portion 164 surrounding the chamber 130. The U-shaped portion 164 has ports 166, 168 communicating with the exhaust ports 160. The ports 166, 168 pass the exhaust air to housings 170, 172 located on either side of the U-shaped portion 164. The housings 170, 172 have an open area filled with an absorbative fiber medium 173 and are enclosed with snap on caps 174, 176. The housing 170,172 have openings 178 through which the air is exhausted after it passes through the fiber.

In operation, the exhausted air from chamber 30 is passed around valve member 142 and out exhaust port 160 into the ports 166, 168. The air is then passed into the chambers 170, 172 and swirls around in the fibers 173 and out openings 178. This condenses and slowly releases the air, as well as this lowers the noise level of the exhausting air. Further, since this slows down the release of the air, the return of piston 18, is slowed down lessening the abrupt action of the piston on the return stroke. This smoother return action makes the tool easier to handle and lessens operator fatigue. For example, it has been determined that with the addition of the muffler 162, the desired noise level is in the area of 70 db. which is sufficiently low to comply with the manufacturing noise level requirements of all countries.

Attention is now directed to FIGS. 1, 2 and 3 which illustrates the mandrel collection system. As a mandrel stem is pulled from its head in the rivet setting operation, the mandrel stem will remain in the jaws 48. After release of the pressure on piston 60, the spring 68 forces the plunger 64 against the jaws 48 to open the jaws which releases the mandrel. It is desirable in an automatic tool of this type to provide means for automatically removing the mandrel stem from the tool. This is accomplished by providing a vacuum in the passageway 180 to draw the mandrel stem through the tool into a container 182 located at the rear of the tool. In this invention, this is accomplished by providing an adapter 184 secured to the rear of the rivet setting mechanism. The adapter 184 contains a transducer 186 which receives air from an air line 188 connected inside the tool to an air source 190 (see FIG. 1). The transducer 186 has a passageway 192 with an opening 194 into the adapter 184. As the air passes through the passageway 192, air is drawn from inside the adapter through opening 194 which creates a vacuum in the inside 196 of the adapter 184. This vacuum in the adapter 184 creates a vacuum in the container 184 which draws the spent mandrel through the tool passageway 180 into the container. The vacuum in the rivet setting mechanism also assists in assembling the rivet mandrel into the nosepiece 46 since the vacuum tends to hold the mandrel into the nosepiece. Further, with the air line enclosed within the body of the tool and passing through the adapter, the entire assembly is enclosed and free from any interference with the operation of the tool. As the spent mandrels are collected, the container 182 merely has to be removed and emptied. This can be accomplished without interference with the vacuum creating mechanism carried on the tool.

We claim:

1. A power operated blind rivet tool adapted to automatically pull the mandrel of a blind rivet to upset the rivet body in a workpiece comprising:

a. a one piece upper housing containing a rivet setting mechanism;

b. a one piece lower housing secured to the upper housing and having a power means to be operated by pressurized air to operate the rivet setting mechanism;

c. a control valve positioned in the bottom of the lower housing to control the supply of air to said power means;

d. said lower housing having a flange surrounding the control valve and forming a flat bottom area to the housing enabling the tool to be set on a flat surface;

e. said upper housing having a trigger area to be held by the tool operator and including a pivotal trigger having one end coacting with an upper trigger rod;

f. a lower trigger rod carried adjacent said lower housing and having an abutment coacting with the lower end of said upper trigger rod;

g. a shoe threaded into the lower end of the lower trigger rod;

h. a plunger connected to said control valve and having a sloped end coacting with the shoe so that upon pivotal movement of said trigger, the trigger rods are moved downwardly forcing said shoe down the sloped surface of the plunger causing the control valve to be opened to pressurize said power means.

2. The power operated blind rivet tool set forth in claim 1 wherein said upper and lower housings have interconnecting flange areas held in mating relationship by clamp means, said clamp means comprising a plurality of U-shaped brackets surrounding said flanged areas, each of said brackets having end portions, said clamp means being retained on said flanges by an annular band, said U-shaped brackets have a flat bottom surface and outwardly extending legs which merge into the bottom surface in an angled shoulder at said end portions.

3. The power operated blind rivet tool set forth in claim 1 wherein said control valve has an exhaust port for exhausting air from the power means, and a muffler for receiving air from the exhaust port to slow down and muffle the air release from the power means.

4. The power operated blind rivet tool of claim 3 wherein said muffler comprises a housing containing a fiberous material in communication with the exhaust port.

5. The power operated blind rivet tool of claim 1 wherein an air line passes from a source of pressurized air internally of the tool to a transducer located in an adapter on the rear of the rivet setting mechanism to create a vacuum through the tool to suck spent mandrels through the tool.

* * * * *